US008873989B2

(12) United States Patent
Honda et al.

(10) Patent No.: US 8,873,989 B2
(45) Date of Patent: Oct. 28, 2014

(54) FIXING DEVICE AND IMAGE FORMING APPARATUS INCORPORATING SAME

(71) Applicants: Haruyuki Honda, Osaka (JP); Tomoyoshi Yamazaki, Tokyo (JP); Toshikane Nishii, Osaka (JP); Hirofumi Horita, Osaka (JP)

(72) Inventors: Haruyuki Honda, Osaka (JP); Tomoyoshi Yamazaki, Tokyo (JP); Toshikane Nishii, Osaka (JP); Hirofumi Horita, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 58 days.

(21) Appl. No.: 13/776,900

(22) Filed: Feb. 26, 2013

(65) Prior Publication Data

US 2013/0243465 A1 Sep. 19, 2013

(30) Foreign Application Priority Data

Mar. 19, 2012 (JP) ..... 2012-061538

(51) Int. Cl.
*G03G 15/20* (2006.01)
*G03G 15/00* (2006.01)

(52) U.S. Cl.
CPC ..... *G03G 15/2053* (2013.01); *G03G 15/2028* (2013.01); *G03G 15/6573* (2013.01); *G03G 15/2039* (2013.01)
USPC ..... 399/70; 399/323

(58) Field of Classification Search
CPC ..... G03G 15/2053; G03G 15/6573; G03G 15/2028; G03G 15/2039; Y10S 271/90
USPC ..... 399/323, 406, 341, 66, 67, 328, 329
See application file for complete search history.

(56) References Cited

U.S. PATENT DOCUMENTS

| | | | | |
|---|---|---|---|---|
| 5,623,332 | A * | 4/1997 | Kawaguchi | 399/308 |
| 2007/0065201 | A1 | 3/2007 | Fujiwara et al. | |
| 2008/0006166 | A1 | 1/2008 | Ohkubo et al. | |
| 2008/0226358 | A1 | 9/2008 | Hanashima et al. | |
| 2009/0121418 | A1 | 5/2009 | Tanaka et al. | |
| 2009/0174135 | A1 | 7/2009 | Tanaka et al. | |
| 2009/0190949 | A1 | 7/2009 | Hamahashi et al. | |
| 2009/0238585 | A1 | 9/2009 | Hayashi et al. | |
| 2009/0295061 | A1 | 12/2009 | Honda et al. | |
| 2009/0302521 | A1 | 12/2009 | Kondo et al. | |
| 2009/0315250 | A1 | 12/2009 | Kimura et al. | |

(Continued)

FOREIGN PATENT DOCUMENTS

| | | |
|---|---|---|
| JP | 11-327336 | 11/1999 |
| JP | 2006-163228 | 6/2006 |
| JP | 2008-116753 | 5/2008 |
| JP | 2009-096605 | 5/2009 |

*Primary Examiner* — David Gray
*Assistant Examiner* — Sevan A Aydin
(74) *Attorney, Agent, or Firm* — Harness, Dickey & Pierce, P.L.C.

(57) ABSTRACT

A fixing device for fixing a toner image on a recording medium includes a hollow, fixing rotary body rotatable in a given direction of rotation and a first heater disposed opposite an inner circumferential surface of the fixing rotary body to heat the fixing rotary body. A pressing rotary body is pressed against the fixing rotary body to form a fixing nip therebetween through which the recording medium bearing the toner image is conveyed. A heat conductor, disposed opposite the first heater and the inner circumferential surface of the fixing rotary body, is disconnectably connected to a guide disposed downstream from the fixing device in a recording medium conveyance direction to guide the recording medium discharged from the fixing nip. The heat conductor conducts heat received from the first heater to the guide.

20 Claims, 5 Drawing Sheets

(56) References Cited

U.S. PATENT DOCUMENTS

| | | | | |
|---|---|---|---|---|
| 2010/0003048 | A1* | 1/2010 | Yamazoe | 399/92 |
| 2010/0019440 | A1 | 1/2010 | Fujiwara et al. | |
| 2010/0192710 | A9 | 8/2010 | Hanashima et al. | |
| 2010/0314827 | A1 | 12/2010 | Nishii et al. | |
| 2011/0058829 | A1 | 3/2011 | Kondo et al. | |
| 2011/0058873 | A1 | 3/2011 | Honda et al. | |
| 2011/0115154 | A1 | 5/2011 | Fujiwara et al. | |
| 2012/0063829 | A1 | 3/2012 | Matsuyama et al. | |
| 2012/0146281 | A1 | 6/2012 | Nishii et al. | |
| 2013/0004221 | A1 | 1/2013 | Honda et al. | |

* cited by examiner

FIXING DEVICE AND IMAGE FORMING APPARATUS INCORPORATING SAME

CROSS-REFERENCE TO RELATED APPLICATION

This patent application is based on and claims priority pursuant to 35 U.S.C. §119 to Japanese Patent Application No. 2012-061538, filed on Mar. 19, 2012, in the Japanese Patent Office, the entire disclosure of which is hereby incorporated by reference herein.

BACKGROUND OF THE INVENTION

1. Field of the Invention

Example embodiments generally relate to a fixing device and an image forming apparatus, and more particularly, to a fixing device for fixing a toner image on a recording medium and an image forming apparatus incorporating the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing roller and a pressing roller pressed against the fixing roller to form a fixing nip therebetween through which the recording medium bearing the toner image is conveyed. The fixing roller is heated by a heater disposed inside the fixing roller. As the fixing roller and the pressing roller rotate and convey the recording medium bearing the toner image through the fixing nip, the fixing roller and the pressing roller apply heat and pressure to the recording medium, thus fixing the toner image on the recording medium. The recording medium bearing the fixed toner image discharged from the fixing nip is conveyed toward the outside of the image forming apparatus while guided by a guide disposed downstream from the fixing device in a recording medium conveyance direction.

However, the guide may be subject to condensation when the cool fixing device is warmed up for fixing operation during cold start, that is, when the fixing device is powered on in the cold morning or heated to a given fixing temperature in a cool environment after a standby mode in which the fixing device waits for a next print job at a temperature lower than the given fixing temperature. If the guide is adhered with water droplets, the water droplets may move onto the recording medium passing over the guide, damaging the toner image on the recording medium.

To address this problem, a plurality of solutions is proposed. For example, as a first solution, the guide may be attached with a heat generator that warms the guide. As a second solution, the guide may be in contact with a conductive heat pipe that warms the guide. As a third solution, a conveyance face of the guide over which the recording medium is conveyed may mount conductive wiring that warms the guide or may be coated with a material that absorbs water droplets adhered to the guide.

However, those solutions to prevent condensation of the guide may require a complex mechanism or a material manufactured at increased costs, failing to prevent condensation of the guide efficiently.

SUMMARY OF THE INVENTION

At least one embodiment may provide a fixing device that fixes a toner image on a recording medium and includes a hollow, fixing rotary body rotatable in a given direction of rotation. A first heater is disposed opposite an inner circumferential surface of the fixing rotary body to heat the fixing rotary body. A pressing rotary body is pressed against the fixing rotary body to form a fixing nip therebetween through which the recording medium bearing the toner image is conveyed. A heat conductor is disposed opposite the first heater and the inner circumferential surface of the fixing rotary body and disconnectably connected to a guide disposed downstream from the fixing device in a recording medium conveyance direction to guide the recording medium discharged from the fixing nip. The heat conductor conducts heat received from the first heater to the guide.

At least one embodiment may provide an image forming apparatus that includes a fixing device detachably attached to the image forming apparatus to fix a toner image on a recording medium and a guide disposed downstream from the fixing device in a recording medium conveyance direction to guide the recording medium discharged from the fixing device. The fixing device includes a fixing rotary body rotatable in a given direction of rotation and a first heater disposed opposite an inner circumferential surface of the fixing rotary body to heat the fixing rotary body. A pressing rotary body is pressed against the fixing rotary body to form a fixing nip therebetween through which the recording medium bearing the toner image is conveyed. A heat conductor is disposed opposite the first heater and the inner circumferential surface of the fixing rotary body and disconnectably connected to the guide. The heat conductor conducts heat received from the first heater to the guide.

Additional features and advantages of example embodiments will be more fully apparent from the following detailed description, the accompanying drawings, and the associated claims.

BRIEF DESCRIPTION OF THE SEVERAL VIEWS OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
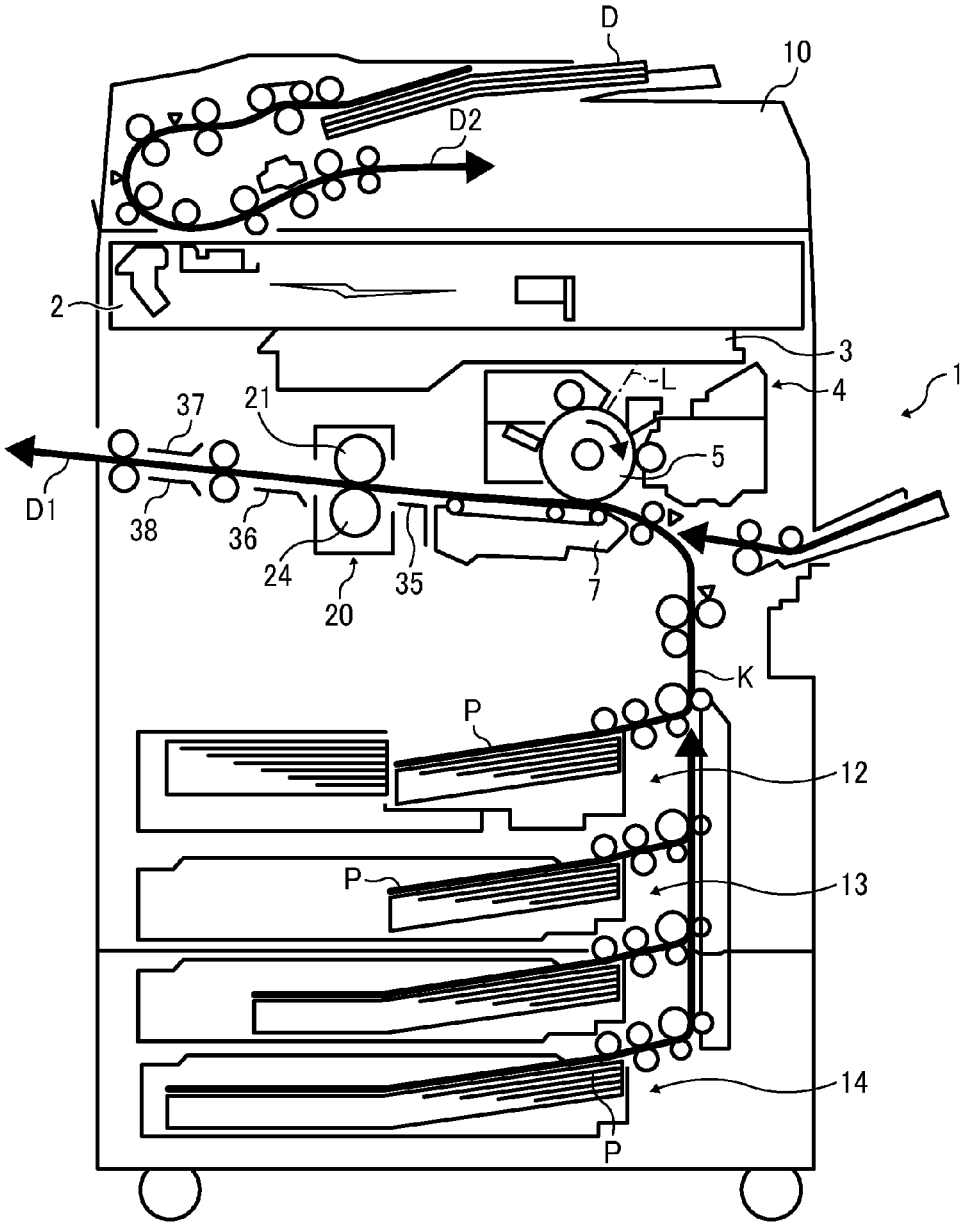
FIG. 1 is a schematic vertical sectional view of an image forming apparatus according to an example embodiment of the present invention.

The accompanying drawings are intended to depict example embodiments and should not be interpreted to limit the scope thereof. The accompanying drawings are not to be considered as drawn to scale unless explicitly noted.

DETAILED DESCRIPTION OF THE INVENTION

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 1 according to an example embodiment is explained.

FIG. 1 is a schematic vertical sectional view of the image forming apparatus 1. The image forming apparatus 1 may be a copier, a facsimile machine, a printer, a multifunction printer (MFP) having at least one of copying, printing, scanning, plotter, and facsimile functions, or the like. According to this example embodiment, the image forming apparatus 1 is a copier that forms a toner image on a recording medium by electrophotography.

The image forming apparatus 1 includes a reader 2, situated at an upper portion of the image forming apparatus 1, to optically read an image on an original document D sent from an auto document feeder (ADF) 10 disposed atop the image forming apparatus 1, thus creating image data. Below the reader 2 is an exposure device 3 that emits light L onto a photoconductive drum 5 of an image forming device 4 located below the exposure device 3 according to the image data sent from the reader 2. Below the image forming device 4 is a transfer device 7 that transfers a toner image formed on the photoconductive drum 5 onto a recording medium P sent from one of a plurality of paper trays 12, 13, and 14 located in a lower portion of the image forming apparatus 1 and loading a plurality of recording media P (e.g., transfer sheets). Downstream from the transfer device 7 in a recording medium conveyance direction D1 is a fixing device 20 incorporating a fixing roller 21 and a pressing roller 24 that fix the toner image on the recording medium P. Upstream from the fixing device 20 in the recording medium conveyance direction D1 is an upstream guide plate 35 that guides the recording medium P conveyed from the transfer device 7 toward the fixing device 20. Downstream from the fixing device 20 in the recording medium conveyance direction D1 are multiple guide plates, that is, a downstream guide plate 36, an upper discharge guide plate 37, and a lower discharge guide plate 38, that guide the recording medium P discharged from the fixing device 20 toward an outside of the image forming apparatus 1.

With reference to FIG. 1, a description is provided of an image forming operation to form a toner image on a recording medium P performed by the image forming apparatus 1 having the structure described above.

A plurality of conveyance rollers incorporated in the ADF 10 feeds an original document D placed on an original document tray toward the reader 2 in a conveyance direction D2. As the original document D travels over the reader 2, the reader 2 optically reads an image on the original document D into image data, that is, an electrical signal. The electrical signal is sent to the exposure device 3 serving as a writer. The exposure device 3 emits light L (e.g., a laser beam) onto the photoconductive drum 5 of the image forming device 4 according to the electrical signal sent from the reader 2, thus forming an electrostatic latent image on the photoconductive drum 5.

The image forming device 4 performs given image forming processes including a charging process, an exposure process, and a development process as the photoconductive drum 5 rotates clockwise in FIG. 1, thus forming a toner image on the photoconductive drum 5 according to the image data created by the reader 2. Thereafter, the transfer device 7 transfers the toner image formed on the photoconductive drum 5 onto a recording medium P conveyed from a registration roller pair disposed upstream from the transfer device 7 in the recording medium conveyance direction D1.

The recording medium P is conveyed to the transfer device 7 as below. One of the plurality of paper trays 12 to 14 is selected manually or automatically. For example, the paper trays 12 to 14 load recording media P of different sizes and orientations, respectively. A user manually selects one of the paper trays 12 to 14 by using a control panel disposed atop the image forming apparatus 1. Alternatively, a controller installed in the image forming apparatus 1 automatically selects one of the paper trays 12 to 14 according to the size and orientation of the original document D read by the reader 2. If the uppermost paper tray 12 is selected, for example, a feed roller attached to the paper tray 12 feeds an uppermost recording medium P from the plurality of recording media P loaded on the paper tray 12 to a conveyance path K extending from the paper trays 12 to 14 to the transfer device 7.

Thereafter, the recording medium P is conveyed to the registration roller pair (e.g., a timing roller pair) through the conveyance path K. As the recording medium P reaches the registration roller pair, the registration roller pair halts the recording medium P temporarily and feeds the recording medium P to the transfer device 7 at a time when the toner image formed on the photoconductive drum 5 reaches the transfer device 7.

As the recording medium P reaches the transfer device 7, the transfer device 7 transfers the toner image formed on the photoconductive drum 5 onto the recording medium P. After passing through the transfer device 7, the recording medium P is conveyed to the fixing device 20 through the upstream guide plate 35 that guides the recording medium P toward the fixing device 20. As the recording medium P is conveyed through the fixing device 20 in a state in which it is sandwiched between the fixing roller 21 and the pressing roller 24, the fixing roller 21 heats the recording medium P and at the same time, together with the pressing roller 24, exerts pressure to the recording medium P, thus fixing the toner image on the recording medium P. The recording medium P bearing the toner image, after discharged from between the fixing roller 21 and the pressing roller 24, is conveyed while guided by the downstream guide plate 36, the upper discharge guide plate 37, and the lower discharge guide plate 38 and discharged from the image forming apparatus 1. Thus, a series of image forming processes is completed.

Figure 2:
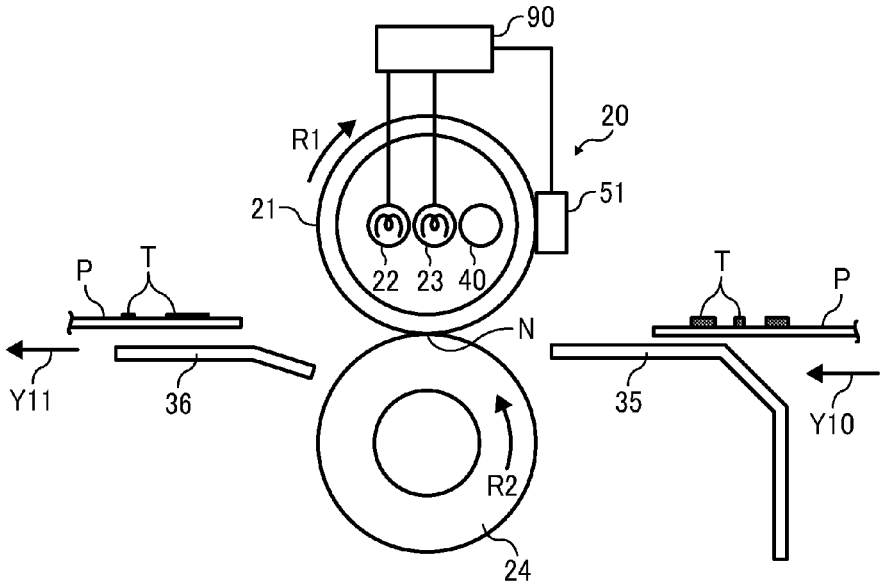
FIG. 2 is a vertical sectional view of a fixing device according to a first example embodiment of the present invention that is installed in the image forming apparatus shown in FIG. 1.
Figure 3:
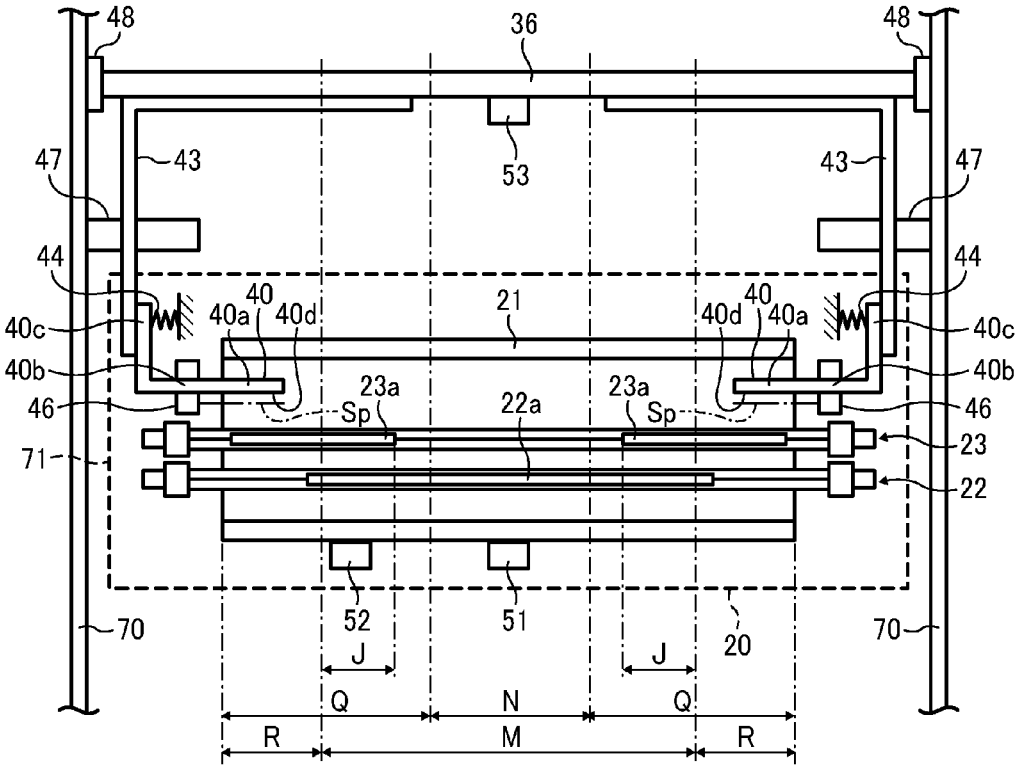
FIG. 3 is a horizontal sectional view of the fixing device shown in FIG. 2.

With reference to FIGS. 2 and 3, a description is provided of a construction of the fixing device 20 incorporated in the image forming apparatus 1 described above.

FIG. 2 is a vertical sectional view of the fixing device 20 according to a first example embodiment. FIG. 3 is a horizontal sectional view of the fixing device 20. As shown in FIG. 2, the fixing device 20 (e.g., a fuser) includes the fixing roller 21 serving as a fixing rotary body rotatable clockwise in a rotation direction R1; the pressing roller 24 rotatable counterclockwise in a rotation direction R2 counter to the rotation direction R1 of the fixing roller 21 and pressed against the fixing roller 21 to form a fixing nip N therebetween; a first heater 23 disposed inside the fixing roller 21; a second heater 22 disposed adjacent to the first heater 23; a heat conductor 40 disposed adjacent to the first heater 23; and a center temperature sensor 51 (e.g., a thermistor) disposed opposite an outer circumferential surface of the fixing roller 21.

A detailed description is now given of a configuration of the fixing roller 21.

As shown in FIG. 2, the fixing roller 21 is a thin tube rotatable in the rotation direction R1. Inside the fixing roller 21 are the two heaters, that is, the first heater 23 and the second heater 22, and the heat conductor 40. The tube of the fixing roller 21 includes a surface layer made of fluoroplastic that facilitates separation of a toner image T on a recording medium P from the fixing roller 21.

As shown in FIG. 3, each of the first heater 23 and the second heater 22 is a bar heater such as a halogen heater. Both lateral ends of the first heater 23 and the second heater 22 in a longitudinal direction thereof parallel to an axial direction of the fixing roller 21 are mounted on a housing 71 (e.g., side plates) of the fixing device 20. As shown in FIG. 2, as the fixing roller 21 is heated by heat radiated from the first heater 23 and the second heater 22 disposed opposite an inner circumferential surface of the fixing roller 21, the fixing roller 21 conducts heat to the toner image T on the recording medium P passing through the fixing nip N. As shown in FIG. 3, the center temperature sensor 51 contacts the outer circumferential surface of the fixing roller 21 at a center of the fixing roller 21 in the axial direction thereof. As shown in FIG. 2, a controller 90, that is, a central processing unit (CPU), provided with a random-access memory (RAM) and a read-only memory (ROM), for example, operatively connected to the center temperature sensor 51, the first heater 23, and the second heater 22, controls the second heater 22 based on the temperature of the fixing roller 21 detected by the center temperature sensor 51 so as to adjust the temperature of the fixing roller 21 to a desired fixing temperature. The heat conductor 40 is interposed between the first heater 23 and the fixing roller 21 in a diametrical direction of the fixing roller 21 in such a manner that the heat conductor 40 is disposed opposite the first heater 23 and the inner circumferential surface of the fixing roller 21. A detailed description of a configuration and an operation of the heat conductor 40, the first heater 23, and the second heater 22 is deferred.

A detailed description is now given of a construction of the pressing roller 24.

A pressurization assembly presses the pressing roller 24 against the fixing roller 21 to form the fixing nip N between the pressing roller 24 and the fixing roller 21 through which the recording medium P bearing the toner image T is conveyed. The pressing roller 24 is constructed of a metal core; an elastic layer coating the metal core via an adhesive layer; and a surface release layer coating the elastic layer. For example, the elastic layer having a thickness in a range of from about 1 mm to about 10 mm is made of fluoro rubber, silicone rubber, silicone rubber foam, or the like. The release layer is a thin surface layer having a thickness not greater than about 300 micrometers. The release layer is made of polyimide, polyetherimide, polyether sulfide (PES), tetrafluoroethylene-perfluoroalkyl vinyl ether copolymer (PFA), or the like. As shown in FIG. 2, the upstream guide plate 35 is located upstream from an entry of the fixing nip N in a recording medium conveyance direction Y10, guiding the recording medium P conveyed from the transfer device 7 depicted in FIG. 1 to the fixing nip N. Conversely, the downstream guide plate 36 is located downstream from an exit of the fixing nip N in a recording medium conveyance direction Y11, guiding the recording medium P discharged from the fixing nip N toward the upper discharge guide plate 37 and the lower discharge guide plate 38 depicted in FIG. 1.

With reference to FIGS. 1 and 2, a description is provided of an operation of the fixing device 20 having the construction described above.

As a main power switch of the image forming apparatus 1 is turned on, a power supply of the image forming apparatus 1 supplies power to the first heater 23 and the second heater 22 disposed inside the fixing roller 21 of the fixing device 20. The controller 90 controls the first heater 23 and the second heater 22 to heat the fixing roller 21 to a desired fixable temperature of about 170 degrees centigrade at which a toner image T is fixable on a recording medium P without failure. Thus, the image forming apparatus 1 becomes ready for an image forming operation to form the toner image T on the recording medium P.

As the image forming apparatus 1 is warmed up, that is, as the fixing roller 21 is heated to the desired fixing temperature, and therefore a user presses a start button on the control panel disposed atop the image forming apparatus 1, a driver (e.g., a motor) drives and rotates the fixing roller 21 in the rotation direction R1. Accordingly, the pressing roller 24 rotates in the rotation direction R2 in accordance with rotation of the fixing roller 21 by friction therebetween at the fixing nip N. Alternatively, the driver may drive and rotate the pressing roller 24 so that the pressing roller 24 rotates the fixing roller 21 by friction therebetween. Yet alternatively, the driver may drive and rotate both the fixing roller 21 and the pressing roller 24.

A recording medium P bearing a toner image T formed by the image forming processes described above is conveyed in the recording medium conveyance direction Y10 to the entry of the fixing nip N while guided by the upstream guide plate 35. As the recording medium P is conveyed through the fixing nip N, the fixing roller 21 heats the recording medium P and at the same time, together with the pressing roller 24, exerts pressure to the recording medium P, thus fixing the toner image T on the recording medium P. Then, the recording medium P bearing the fixed toner image T is discharged from the fixing nip N and conveyed in the recording medium conveyance direction Y11. Thereafter, the recording medium P is conveyed through the conveyance path K toward the upper discharge guide plate 37 and the lower discharge guide plate 38 while guided by the downstream guide plate 36.

With reference to FIGS. 2 to 4B, a description is provided of a detailed configuration of the fixing device 20.

It is to be noted that, in the description below, a passage span defines a span of the fixing roller 21 in the axial direction thereof parallel to a width direction of the recording medium P over which the recording medium P passes or is conveyed. Conversely, a non-passage span defines a span of the fixing roller 21 in the axial direction thereof over which the recording medium P does not pass or is not conveyed. Further, the width direction defines a direction perpendicular to the recording medium conveyance directions Y10 and Y11.

With reference to FIGS. 2 and 3, a detailed description is now given of a construction of the first heater 23 and the second heater 22.

As shown in FIGS. 2 and 3, the two heaters, that is, the first heater 23 and the second heater 22, are situated inside the fixing roller 21. As shown in FIG. 3, the second heater 22 is disposed opposite the inner circumferential surface of the fixing roller 21 to heat a center of the fixing roller 21 in the axial direction thereof. For example, the second heater 22 includes a center light emitter 22*a* disposed opposite and heating the center of the fixing roller 21 in the axial direction thereof parallel to the width direction of the recording medium P. The center of the fixing roller 21 in the axial direction thereof disposed opposite the center light emitter 22*a* is defined as a passage span M where a recording medium P of the maximum size available in the image forming apparatus 1 passes over the fixing roller 21. For example, according to this example embodiment, the passage span M has a width of about 297 mm in the axial direction of the fixing roller 21, that is, the width of an A4 size recording medium in landscape orientation. Hence, the center light emitter 22*a* of the second heater 22 is disposed opposite the passage span M of the fixing roller 21 where the maximum size recording medium P is conveyed.

The controller 90 depicted in FIG. 2 controls, that is, turns on and off, the second heater 22 based on the temperature of the center on the outer circumferential surface of the fixing roller 21 in the axial direction thereof detected by the center temperature sensor 51. For example, if the center temperature sensor 51 detects that the temperature of the fixing roller 21 is below a target fixing temperature, for example, a target control temperature of about 180 degrees centigrade, the controller 90 controls the power supply to supply power to the second heater 22. Conversely, if the center temperature sensor 51 detects that the temperature of the fixing roller 21 reaches the target fixing temperature, the controller 90 controls the power supply to interrupt power supply to the second heater 22.

In contrast to the second heater 22, the first heater 23 is disposed opposite the inner circumferential surface of the fixing roller 21 to heat both lateral ends of the fixing roller 21 in the axial direction thereof. For example, as shown in FIG. 3, the first heater 23 includes a lateral end light emitter 23*a* disposed opposite and heating each lateral end of the fixing roller 21 in the axial direction thereof. Each lateral end of the fixing roller 21 in the axial direction thereof disposed opposite each lateral end light emitter 23*a* is defined as a non-passage span Q where a recording medium P of the minimum size available in the image forming apparatus 1 does not pass. For example, according to this example embodiment, the minimum size recording medium P has a width of about 148 mm in the axial direction of the fixing roller 21, that is, the width of an A5 size recording medium in portrait orientation. Each lateral end light emitter 23*a* is disposed outboard from a passage span N of the fixing roller 21 where the minimum size recording medium P is conveyed in the axial direction of the fixing roller 21 and overlaps the passage span M of the fixing roller 21 where the maximum size recording medium P passes in the axial direction of the fixing roller 21.

With reference to FIG. 3, a detailed description is now given of a construction of the heat conductor 40.

As shown in FIG. 3, a part of the heat conductor 40 is disposed opposite the inner circumferential surface of the fixing roller 21 and the lateral end light emitter 23*a* at each lateral end of the fixing roller 21 in the axial direction thereof. The heat conductor 40, made of conductive metal, is disconnectably connected to the downstream guide plate 36 located outside the fixing device 20, thus conducting heat to the downstream guide plate 36. The heat conductor 40 formed in a substantially L shape in cross-section in FIG. 3 is constructed of an inboard end 40*a*, a center portion 40*b*, and an outboard end 40*c*. The inboard end 40*a* is disposed opposite the first heater 23 at a non-passage span R of the fixing roller 21 where the maximum size recording medium P does not pass that is situated outboard from the passage span M of the fixing roller 21 where the maximum size recording medium P passes. The center portion 40*b*, disposed outboard from the inboard end 40*a* in the axial direction of the fixing roller 21, is supported by the housing 71 of the fixing device 20 via an insulator 46 serving as a heat conductor insulator. The outboard end 40*c* is separatably in substantially planar contact with a joint 43 mounted on the downstream guide plate 36.

The joint 43 is in substantially planar contact with the downstream guide plate 36. The joint 43 is mounted on the side plate 70 constituting a frame of the image forming apparatus 1 through an insulator 47 serving as a joint insulator. The downstream guide plate 36 is mounted on the side plate 70 through an insulator 48 serving as a guide insulator. The downstream guide plate 36 and the joint 43 are made of conductive metal.

As the first heater 23 heats the fixing roller 21, heat radiated from the first heater 23 is conducted to the heat conductor 40 that in turn conducts heat to the downstream guide plate 36 through the joint 43, warming the downstream guide plate 36 and thereby preventing condensation. The first heater 23 prevents not only condensation of the downstream guide plate 36 but also decreased temperature of both lateral ends of the fixing roller 21 in the axial direction thereof that may arise during so-called cold start as described below. Accordingly, compared to a configuration in which a separate heater for heating the downstream guide plate 36 only is provided in addition to another heater for heating the fixing roller 21, the fixing device 20 prevents condensation of the downstream guide plate 36 efficiently with the relatively simple structure manufactured at reduced costs.

Cold start defines warming up of the fixing device 20 from relatively low temperature, for example, when the image forming apparatus 1 is powered on in the cold morning or warmed up from a standby mode in which the image forming apparatus 1 waits for a print job while the fixing roller 21 is maintained at a temperature lower than the desired fixing temperature in a cool environment. During cold start, condensation may form on the downstream guide plate 36 and water droplets may adhere to the downstream guide plate 36. To address this circumstance, the power supply supplies power to the first heater 23 during cold start. Thus, heat radiated from the first heater 23 is conducted to the downstream guide plate 36 through the heat conductor 40 and the joint 43, preventing condensation on the downstream guide plate 36 that may arise during cold start. Accordingly, water droplets may not adhere to the downstream guide plate 36, preventing movement of the water droplets to the recording medium P sliding over the downstream guide plate 36 and resultant failure of damaging the toner image T on the recording medium P. According to this example embodiment, the heat conductor 40 is connected to the downstream guide plate 36 disposed downstream from the fixing nip N in the recording medium conveyance direction Y11. It is because, during cold start, the downstream guide plate 36 receives heat from the recording medium P heated to a relatively high temperature at the fixing nip N and is subject to condensation.

To address this problem, the downstream guide plate 36 and the components located in a heat conduction path interposed between the first heater 23 and the downstream guide plate 36, that is, the heat conductor 40 and the joint 43, are mounted on the side plates 70 of the image forming apparatus 1 and the housing 71 of the fixing device 20 through the insulators 48, 47, and 46. For example, the downstream guide plate 36 is mounted on the side plates 70 of the image forming apparatus 1 through the insulators 48. Each joint 43 is mounted on the side plate 70 of the image forming apparatus 1 through the insulator 47. Each heat conductor 40 is mounted on the housing 71 of the fixing device 20 through the insulator 46. Accordingly, heat is not radiated from the downstream guide plate 36, the joints 43, and the heat conductors 40 to the side plates 70 of the image forming apparatus 1 and the housing 71 of the fixing device 20. The insulators 46 to 48 are made of heat-resistant insulative resin. According to this example embodiment, the heat conductor 40 is connected to the downstream guide plate 36 indirectly through the joint 43. Alternatively, the heat conductor 40 may be connected to the downstream guide plate 36 directly, not through the joint 43.

At least an opposed face 40*d* of the heat conductor 40 disposed opposite the first heater 23 is treated in black. For example, the opposed face 40*d* of the heat conductor 40 extending over a span Sp in the axial direction of the fixing roller 21 shown in the broken line in FIG. 3 is coated in black or black plated. Accordingly, the heat conductor 40 absorbs an increased amount of infrared rays, that is, light and heat, radiated from the first heater 23. Consequently, the heat conductor 40 warms up the downstream guide plate 36 efficiently, minimizing condensation of the downstream guide plate 36 effectively. According to this example embodiment, the opposed face 40*d* of the heat conductor 40 disposed opposite the first heater 23 is curved or convex with respect to the first heater 23 in cross-section as shown in FIG. 2. Alternatively, the opposed face 40*d* of the heat conductor 40 may be planar or concave with respect to the first heater 23 in cross-section.

Figure 4A:
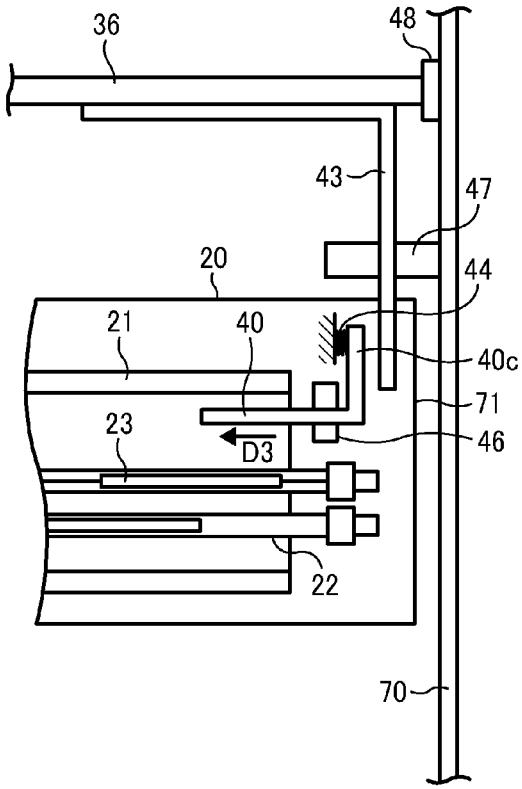
FIG. 4A is a partial horizontal sectional view of the fixing device shown in FIG. 3 detached from the image forming apparatus shown in FIG. 1.
Figure 4B:
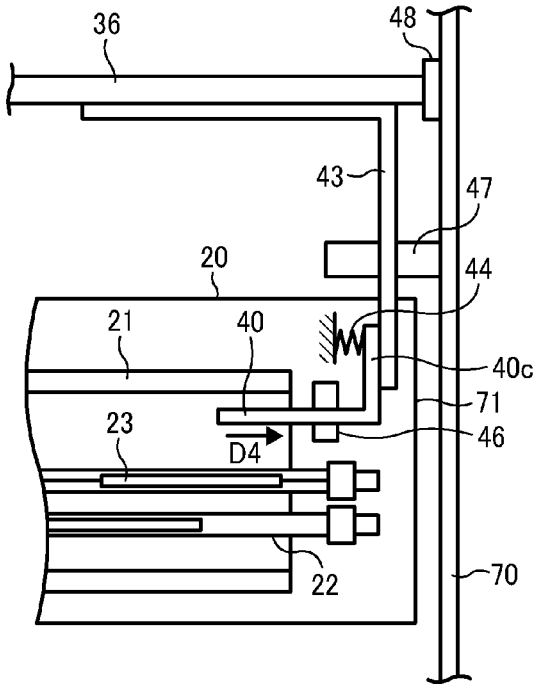
FIG. 4B is a partial horizontal sectional view of the fixing device shown in FIG. 3 attached to the image forming apparatus shown in FIG. 1.

With reference to FIGS. 4A and 4B, a description is provided of movement of the heat conductor 40 as the fixing device 20 is detached from and attached to the image forming apparatus 1.

FIG. 4A is a partial horizontal sectional view of the fixing device 20 detached from the image forming apparatus 1. FIG. 4B is a partial horizontal sectional view of the fixing device 20 attached to the image forming apparatus 1. As shown in FIG. 4A, as the fixing device 20 is detached from the image forming apparatus 1, the heat conductor 40 is movable in a direction D3 with respect to the housing 71 of the fixing device 20. Conversely, as shown in FIG. 4B, as the fixing device 20 is attached to the image forming apparatus 1, the heat conductor 40 is movable in a direction D4 with respect to the housing 71 of the fixing device 20. Although not shown, the left heat conductor 40 situated at another end, that is, the left end in FIG. 3, of the fixing device 20 in the axial direction of the fixing roller 21 is movable with respect to the housing 71 of the fixing device 20 symmetrically to movement of the right heat conductor 40 shown in FIGS. 4A and 4B.

A compression spring 44 is interposed between the heat conductor 40 and the housing 71 of the fixing device 20. For example, one end of the compression spring 44 is anchored to the housing 71 of the fixing device 20. Another end of the compression spring 44 is anchored to the outboard end 40*c* of the heat conductor 40 disposed opposite the joint 43. Thus, the compressing spring 44 serves as a biasing member that biases the heat conductor 40 against the joint 43. Accordingly, as the fixing device 20 is detached from the image forming apparatus 1, the heat conductor 40 is separated from the joint 43 and therefore is disconnected from the downstream guide plate 36 as shown in FIG. 4A. Conversely, as the fixing device 20 is attached to the image forming apparatus 1, the heat conductor 40 comes into contact with the joint 43 and therefore is connected to the downstream guide plate 36 as shown in FIG. 4B.

For example, as shown in FIG. 4A, as the fixing device 20 is detached from the image forming apparatus 1, the heat conductor 40 is isolated from the joint 43, interrupting the heat conduction path through which heat radiated from the first heater 23 is conducted to the downstream guide plate 36. Conversely, as shown in FIG. 4B, as the fixing device 20 is attached to the image forming apparatus 1, the heat conductor 40 comes into contact with the joint 43, connecting the heat conduction path through which heat radiated from the first heater 23 is conducted to the downstream guide plate 36. Thus, the fixing device 20 incorporating the heat conductor 40 is detachably attached to the image forming apparatus 1, facilitating maintenance of the fixing device 20.

Figure 5:
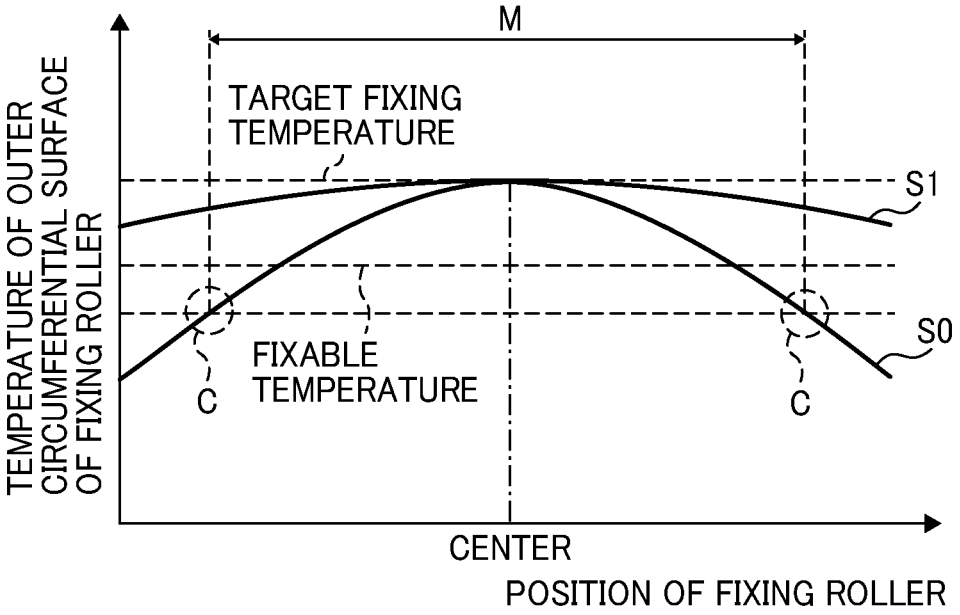
FIG. 5 is a graph showing a relation between the position of a fixing roller incorporated in the fixing device shown in FIG. 3 and the temperature of an outer circumferential surface of the fixing roller during cold start.

With reference to FIGS. 3 and 5, a description is provided of turning on and off of the first heater 23 and the second heater 22.

As shown in FIG. 3, the passage span M of the fixing roller 21 where the maximum size recording medium P is conveyed and the center light emitter 22*a* of the second heater 22 is disposed opposite the fixing roller 21 overlaps each non-passage span Q where the minimum size recording medium P is not conveyed and the lateral end light emitter 23*a* of the first heater 23 is disposed opposite the fixing roller 21. That is, the center light emitter 22*a* of the second heater 22 overlaps each lateral end light emitter 23*a* of the first heater 23 in the axial direction of the fixing roller 21. Accordingly, each lateral end light emitter 23*a* of the first heater 23 heats each lateral end J of the passage span M where the maximum size recording medium P is conveyed. During cold start, as the controller 90 depicted in FIG. 2 turns on the second heater 22, the controller 90 turns on the first heater 23 simultaneously. It is because, during cold start, heat may be radiated from both lateral ends of the fixing roller 21 in the axial direction thereof to peripheral components and space readily, heating both lateral ends of the fixing roller 21 insufficiently.

FIG. 5 is a graph showing temperature distribution of the outer circumferential surface of the fixing roller 21 during cold start. The horizontal axis of the graph represents the position on the fixing roller 21 in the axial direction thereof. The vertical axis of the graph represents the temperature of the outer circumferential surface of the fixing roller 21. A curve S0 represents a temperature distribution of the fixing roller 21 when the fixing device 20 is warmed up by turning on the second heater 22 and turning off the first heater 23. A curve S1 represents a temperature distribution of the fixing roller 21 when the fixing device 20 is warmed up by turning on both the first heater 23 and the second heater 22 according to this example embodiment. The curve S0 shows that, when only the second heater 22 is turned on, the temperatures of both lateral ends of the fixing roller 21 indicated by the broken circles C in the axial direction thereof are lower than a fixable temperature, which may cause fixing failure at both lateral ends of the fixing roller 21 in the axial direction thereof. Conversely, the curve S1 shows that, when both the first heater 23 and the second heater 22 are turned on, the temperature of the fixing roller 21 is maintained higher than the fixable temperature throughout the entire width of the fixing roller 21 in the axial direction thereof.

Thus, the first heater 23 used to prevent a decreased temperature of both lateral ends of the fixing roller 21 in the axial direction thereof that is lower than the fixable temperature during cold start is also used to prevent condensation of the downstream guide plate 36 during cold start. That is, the fixing device 20 prevents condensation of the downstream guide plate 36 efficiently with the relatively simple structure manufactured at reduced costs.

As shown in FIG. 3, a lateral end temperature sensor 52 serves as a first temperature detector disposed opposite one lateral end of the fixing roller 21 in the axial direction thereof to detect the temperature of the lateral end of the fixing roller 21. For example, the lateral end temperature sensor 52 may be a thermistor disposed opposite the lateral end light emitter 23*a* of the first heater 23 and in contact with the outer circumferential surface of the fixing roller 21. After the controller 90 depicted in FIG. 2 turns on the first heater 23 to warm up the fixing device 20, the controller 90 turns on and off the first heater 23 based on the temperature of the fixing roller 21 detected by the lateral end temperature sensor 52 so that the temperature of the fixing roller 21 exceeds the fixable temperature and reaches the target fixing temperature.

As shown in FIG. 3, a guide plate temperature sensor 53 serves as a second temperature detector disposed opposite the downstream guide plate 36 to detect the temperature of the downstream guide plate 36. For example, the guide plate temperature sensor 53 may be a thermistor in contact with a surface of the downstream guide plate 36. After the controller 90 turns on the first heater 23 to warm up the fixing device 20, the controller 90 turns off the first heater 23 when a first condition and a second condition are satisfied. For example, the first condition defines that the temperature of the fixing roller 21 detected by the lateral end temperature sensor 52 reaches the fixable temperature. The second condition defines that the temperature of the downstream guide plate 36 detected by the guide plate temperature sensor 53 reaches a given temperature at or above which condensation of the downstream guide plate 36 does not occur. When both the first condition and the second condition are satisfied, condensation of the downstream guide plate 36 is prevented precisely during cold start.

Figure 6:
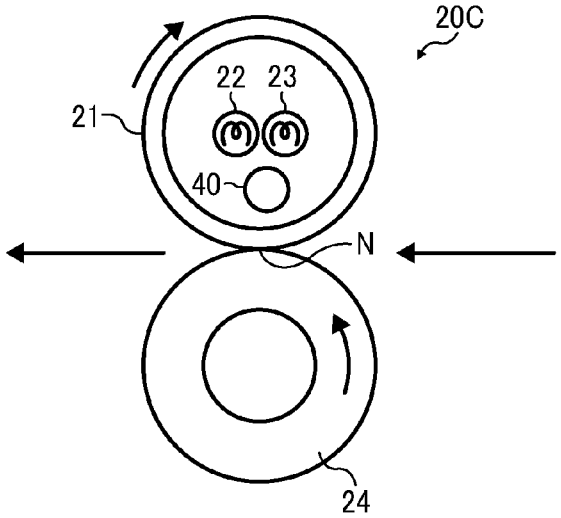
FIG. 6 is a vertical sectional view of a comparative fixing device.

With reference to FIGS. 2 and 6, a description is provided of the position of the heat conductor 40.

As shown in FIG. 2, the heat conductor 40 is disposed opposite the first heater 23 at a position other than the fixing nip N. That is, the heat conductor 40 is not interposed between the first heater 23 and the fixing nip N in the diametrical direction of the fixing roller 21. FIG. 6 is a vertical sectional view of a comparative fixing device 20C incorporating the heat conductor 40 interposed between the first heater 23 and the fixing nip N in the diametrical direction of the fixing roller 21. If the heat conductor 40 is interposed between the first heater 23 and the fixing nip N in the diametrical direction of the fixing roller 21, the heat conductor 40 may block light radiated from the first heater 23, obstructing heating of the fixing roller 21 at the fixing nip N by light radiated from the first heater 23. Insufficient heating of the fixing roller 21 at the fixing nip N may degrade quality of the toner image T fixed on the recording medium P. To address this circumstance, according to this example embodiment, the heat conductor 40 is not interposed between the first heater 23 and the fixing nip N in the diametrical direction of the fixing roller 21 as shown in FIG. 2 to allow light radiated from the first heater 23 to irradiate and heat the fixing roller 21 at the fixing nip N, thus heating the fixing roller 21 sufficiently at the fixing nip N.

Figure 7:
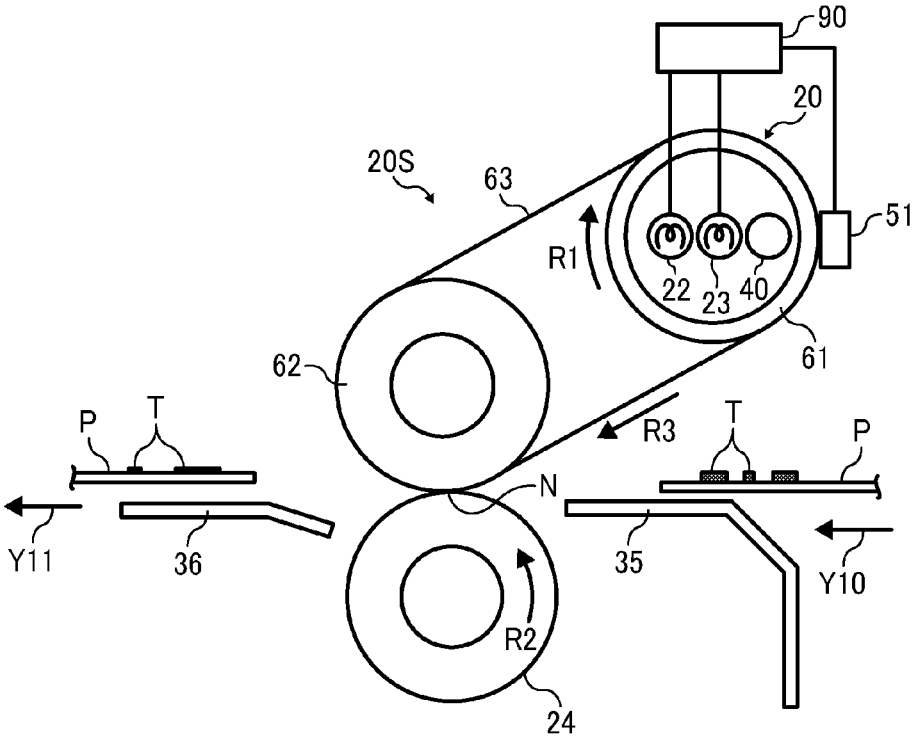
FIG. 7 is a vertical sectional view of a fixing device according to a second example embodiment of the present invention.

The fixing device 20 depicted in FIG. 2 employs the fixing roller 21 as a fixing rotary body pressing against the pressing roller 24 and heating the recording medium P bearing the toner image T. Alternatively, a fixing belt may be employed as a fixing rotary body as shown in FIG. 7. FIG. 7 is a vertical sectional view of a fixing device 20S according to a second example embodiment that incorporates a fixing belt 63 serving as a fixing rotary body pressing against the pressing roller 24 and heating a recording medium P bearing a toner image T.

As shown in FIG. 7, the fixing belt 63 is stretched across and supported by a heating roller 61 and an auxiliary fixing roller 62. The heating roller 61 serves as a heating rotary body inside which the first heater 23, the second heater 22, and the heat conductor 40 are situated. The auxiliary fixing roller 62 presses against the pressing roller 24 via the fixing belt 63 to form the fixing nip N between the fixing belt 63 and the pressing roller 24 through which the recording medium P bearing the toner image T is conveyed. As the driver drives and rotates the heating roller 61 clockwise in FIG. 7 in the rotation direction R1, the heating roller 61 rotates the fixing belt 63 clockwise in FIG. 7 in a rotation direction R3 by friction therebetween. Then, the fixing belt 63 rotates the pressing roller 24 counterclockwise in FIG. 7 in the rotation direction R2 by friction therebetween. As the recording medium P bearing the toner image T is conveyed through the fixing nip N, the fixing belt 63 heated by the first heater 23 and the second heater 22 via the heating roller 61, together with the pressing roller 24, apply heat and pressure to the recording medium P, thus fixing the toner image T on the recording medium P.

Alternatively, the driver may be connected to the pressing roller 24 to drive and rotate the pressing roller 24 so that the pressing roller 24 rotates the fixing belt 63 by friction therebetween. Yet alternatively, the driver may be connected to the auxiliary fixing roller 62 to drive and rotate the auxiliary fixing roller 62 so that the auxiliary fixing roller 62 rotates the fixing belt 63 by friction therebetween. Yet alternatively, the driver may drive and rotate at least two of the heating roller 61, the pressing roller 24, and the auxiliary fixing roller 62.

The fixing belt 63 is an endless belt constructed of a base layer, an elastic layer coating the base layer, and a surface layer coating the elastic layer. Similarly to the fixing device 20 shown in FIG. 3, the fixing device 20S includes the first heater 23, the second heater 22, and the heat conductor 40 disposed inside the heating roller 61. For example, each heat conductor 40 is disposed opposite the first heater 23 and connected to the downstream guide plate 36 through the joint 43 to conduct heat received from the first heater 23 to the downstream guide plate 36 through the joint 43, thus attaining advantages equivalent to those of the fixing device 20 described above.

With reference to FIGS. 1, 3, and 7, a description is provided of advantages of the fixing devices 20 and 20S described above.

The fixing device (e.g., the fixing devices 20 and 20S) includes a fixing rotary body (e.g., the fixing roller 21 and the fixing belt 63) and the first heater 23 disposed opposite an inner circumferential surface of the fixing rotary body to heat the fixing rotary body. A pressing rotary body (e.g., the pressing roller 24) is pressed against the fixing rotary body to form the fixing nip N therebetween through which a recording medium P is conveyed. A guide (e.g., the downstream guide plate 36) is disposed downstream from the fixing device in the recording medium conveyance direction Y11 to guide the recording medium P discharged from the fixing nip N. The heat conductor 40 is interposed between the inner circumferential surface of the fixing rotary body and the first heater 23 in a diametrical direction of the fixing rotary body and disconnectably connected to the guide to conduct heat received from the first heater 23 to the guide.

The heat conductor 40 is interposed between the first heater 23 and the fixing rotary body in the diametrical direction of the fixing rotary body in such a manner that the heat conductor 40 is disposed opposite the inner circumferential surface of the fixing rotary body and the first heater 23 disposed inside the fixing rotary body. The heat conductor 40 is disconnectably connected to the guide to conduct heat received from the first heater 23 to the guide. Thus, the heat conductor 40 warms the guide with the relatively simple structure of the fixing device manufactured at reduced costs and installed in the image forming apparatus 1, thus preventing condensation of the guide efficiently.

As shown in FIG. 1, according to the example embodiments described above, the fixing devices 20 and 20S are installable in the monochrome image forming apparatus 1 incorporating the single image forming device 4 that forms a monochrome toner image on a recording medium. Alternatively, the fixing devices 20 and 20S may be installed in an image forming apparatus incorporating a plurality of image forming devices that forms a color toner image on a recording medium. Further, according to the example embodiments described above, the pressing roller 24 is used as a pressing rotary body pressed against a fixing rotary body (e.g., the fixing roller 21 and the fixing belt 63). Alternatively, an endless pressing belt may be used as a pressing rotary body pressed against the fixing rotary body, thus attaining the advantages described above.

As shown in FIG. 3, according to the example embodiments described above, the heat conductors 40 are disconnectably connected to the downstream guide plate 36 through the joints 43 to conduct heat received from the first heater 23 to the downstream guide plate 36 through the joints 43, warming the downstream guide plate 36 and thereby preventing condensation of the downstream guide plate 36. Alternatively, the heat conductors 40 may be connected to one or more of other guides (e.g., the upstream guide plate 35, the upper discharge guide plate 37, and the lower discharge guide plate 38).

Further, according to the example embodiments described above, the second heater 22 is separately provided from the first heater 23. Alternatively, the first heater 23 and the second heater 22 may be combined into a single heater. In this case, the heat conductors 40 and the joints 43 may be disposed opposite the single heater, attaining the advantages described above.

Moreover, according to the example embodiments described above, the recording medium P is conveyed through the fixing nip N in a state in which it is centered in the axial direction of the fixing roller 21. Hence, the heat conductor 40 and the joint 43 are disposed opposite each lateral end of the fixing roller 21 in the axial direction thereof. That is, two sets of the heat conductor 40 and the joint 43 are disposed opposite the fixing roller 21. Alternatively, the recording medium P may be conveyed through the fixing nip N in a state in which it is aligned along one lateral edge of the fixing roller 21 in the axial direction thereof. Hence, the single heat conductor 40 and the single joint 43 may be disposed opposite one lateral end of the fixing roller 21 in the axial direction thereof. That is, one set of the heat conductor 40 and the joint 43 may be disposed opposite the fixing roller 21. In this case, the single lateral end light emitter 23*a* of the first heater 23 is also disposed opposite one lateral end of the fixing roller 21 in the axial direction thereof.

The present invention has been described above with reference to specific example embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative example embodiments may be combined with each other and/or substituted for each other within the scope of the present invention.

What is claimed is:

1. A fixing device for fixing a toner image on a recording medium, comprising:

a hollow, fixing rotary body rotatable in a given direction of rotation;

a first heater disposed opposite an inner circumferential surface of the fixing rotary body to heat the fixing rotary body;

a pressing rotary body pressed against the fixing rotary body to form a fixing nip therebetween through which the recording medium bearing the toner image is conveyed; and a heat conductor disposed opposite the first heater and the inner circumferential surface of the fixing rotary body and that comes into and out of contact with a guide disposed downstream from the fixing device in a recording medium conveyance direction to guide the recording medium discharged from the fixing nip, the heat conductor to conduct heat received from the first heater to the guide.

2. The fixing device according to claim 1, wherein the heat conductor is disposed opposite the first heater in a non-passage span of the fixing rotary body extending in an axial direction thereof where a maximum size recording medium does not pass over the fixing rotary body.

3. The fixing device according to claim 1, wherein the heat conductor is interposed between the first heater and the fixing rotary body in a diametrical direction of the fixing rotary body at a position other than the fixing nip.

4. The fixing device according to claim 1, wherein the first heater includes a lateral end light emitter disposed opposite and heating a lateral end of the fixing rotary body in an axial direction thereof.

5. The fixing device according to claim 4, further comprising a second heater disposed opposite the inner circumferential surface of the fixing rotary body to heat the fixing rotary body, the second heater including a center light emitter disposed opposite and heating a center of the fixing rotary body in the axial direction thereof.

6. The fixing device according to claim 5, wherein the first heater is interposed between the second heater and the heat conductor in a diametrical direction of the fixing rotary body.

7. The fixing device according to claim 5, wherein the lateral end light emitter of the first heater overlaps the center light emitter of the second heater in the axial direction of the fixing rotary body.

8. The fixing device according to claim 4, wherein the lateral end light emitter of the first heater is disposed opposite the fixing rotary body in a non-passage span of the fixing rotary body where a minimum size recording medium does not pass over the fixing rotary body.

9. The fixing device according to claim 4, further comprising:

a first temperature detector disposed opposite the lateral end light emitter of the first heater via the fixing rotary body to detect a temperature of the lateral end of the fixing rotary body in the axial direction thereof; and a second temperature detector disposed opposite the guide to detect a temperature of the guide.

10. The fixing device according to claim 9, wherein after the first heater is turned on to warm up the fixing device, the first heater is turned off when a first condition and a second condition are satisfied, and wherein the first condition defines that the temperature of the fixing rotary body detected by the first temperature detector reaches a fixable temperature at which the toner image is fixable on the recording medium and the second condition defines that the temperature of the guide detected by the second temperature detector reaches a given temperature at or above which condensation of the guide does not occur.

11. The fixing device according to claim 1, further comprising:

a housing housing the fixing rotary body, the first heater, the pressing rotary body, and the heat conductor; and a heat conductor insulator mounted on the housing and mounting the heat conductor.

12. The fixing device according to claim 11, further comprising a joint interposed between the heat conductor and the guide to conduct heat received from the heat conductor to the guide.

13. The fixing device according to claim 12, further comprising a biasing member anchored to the housing and the heat conductor to bias the heat conductor against the joint.

14. The fixing device according to claim 12, wherein the heat conductor includes:

an inboard end disposed opposite the first heater;

a center portion disposed outboard from the inboard end in an axial direction of the fixing rotary body and supported by the housing through the heat conductor insulator; and an outboard end contiguous to the center portion and separatably contacting the joint.

15. The fixing device according to claim 1, wherein the heat conductor includes an opposed face disposed opposite the first heater and coated in black.

16. The fixing device according to claim 1, wherein the fixing rotary body includes one of a fixing roller and a fixing belt.

17. An image forming apparatus comprising:

a fixing device, detachably attached to the image forming apparatus, to fix a toner image on a recording medium; and a guide disposed downstream from the fixing device in a recording medium conveyance direction to guide the recording medium discharged from the fixing device, the fixing device including:

a fixing rotary body rotatable in a given direction of rotation;

a first heater disposed opposite an inner circumferential surface of the fixing rotary body to heat the fixing rotary body;

a pressing rotary body pressed against the fixing rotary body to form a fixing nip therebetween through which the recording medium bearing the toner image is conveyed; and a heat conductor disposed opposite the first heater and the inner circumferential surface of the fixing rotary body and that comes into and out of contact with the guide, the heat conductor to conduct heat received from the first heater to the guide.

18. The image forming apparatus according to claim 17, wherein the heat conductor of the fixing device comes into contact with the guide when the fixing device is attached to the image forming apparatus.

19. The image forming apparatus according to claim 17, further comprising:

a frame; and a guide insulator mounted on the frame and mounting the guide.

20. The image forming apparatus according to claim 19, further comprising a joint insulator mounted on the frame, wherein the fixing device further includes a joint mounted on the joint insulator and interposed between the heat conductor and the guide to conduct heat received from the heat conductor to the guide.

* * * * *